US007902762B2

(12) United States Patent
Chen

(10) Patent No.: US 7,902,762 B2
(45) Date of Patent: Mar. 8, 2011

(54) SYSTEM AND METHOD FOR DRIVING LED WITH HIGH EFFICIENCY IN POWER CONSUMPTION

(75) Inventor: Chin-Zung Chen, Tainan (TW)

(73) Assignee: Himax Display, Inc., Tainan (TW)

( * ) Notice: Subject to any disclaimer, the term of this patent is extended or adjusted under 35 U.S.C. 154(b) by 432 days.

(21) Appl. No.: 12/168,077

(22) Filed: Jul. 4, 2008

(65) Prior Publication Data

US 2010/0001657 A1 Jan. 7, 2010

(51) Int. Cl.
*H05B 37/02* (2006.01)

(52) U.S. Cl. ..... 315/209 R; 315/247; 315/291; 315/299

(58) Field of Classification Search ..... 315/209 R, 315/224, 247, 283, 291, 299
See application file for complete search history.

(56) References Cited

U.S. PATENT DOCUMENTS

| | | | | |
|---|---|---|---|---|
| 6,888,383 | B1 * | 5/2005 | Fairbanks | 327/124 |
| 7,265,504 | B2 * | 9/2007 | Grant | 315/308 |
| 2005/0207196 | A1 * | 9/2005 | Holmes et al. | 363/126 |
| 2009/0237007 | A1 * | 9/2009 | Leng | 315/297 |

* cited by examiner

*Primary Examiner* — Thuy Vinh Tran
(74) *Attorney, Agent, or Firm* — Thomas, Kayden, Horstemeyer & Risley, LLP

(57) ABSTRACT

A system and method for driving a LED is disclosed. The system is switched in turn between a constant-current mode circuit and a constant-voltage mode circuit. Accordingly, the forward voltage of the LED could be maintained constant, and the efficiency in power consumption could be substantially increased.

11 Claims, 5 Drawing Sheets

SYSTEM AND METHOD FOR DRIVING LED WITH HIGH EFFICIENCY IN POWER CONSUMPTION

BACKGROUND OF THE INVENTION

1. Field of the Invention

The present invention generally relates to driving light-emitting diode (LED), and more particularly to system and method for driving the LED with high efficiency in power consumption.

2. Description of the Prior Art

The light-emitting diode (LED) is widely used in a variety of electronic devices for diverse purposes. For example, the LEDs may be utilized in the backlight module of a liquid crystal display (LCD) to provide backlight, or may provide flash light in a charge-couple device (CCD) camera. In practice, the LED is, however, temperature dependent, or, in other words, the characteristics of the LED vary according to its temperature. FIG. 1 shows an LED and its equivalent circuit. The LED is equivalently made of a voltage source connected in series with a negative-temperature-coefficient (NTC) resistor. The resistance of the NTC resistor falls with increasing temperature caused by the current flowing through the LED, and vice versa. Accordingly, the voltage potential across the anode and the cathode electrode of the LED (or the forward voltage VF) decreases with increasing temperature by a constant current flowing through, and vice versa.

There are two conventional methods for driving the LED or LEDs: the constant-voltage driving method and the constant-current driving method. In the conventional constant-voltage driving method, the anode electrode of the LED controllably receives a constant-voltage supply. As discussed above, the current flowing through the LED will vary even though the anode electrode receives the constant voltage. Consequently, the LED suffers varying driving current, and thus its associated illuminance. Furthermore, the LED in the conventional constant-voltage driving method is typically connected in series with a current-limiting resistor, which disadvantageously consumes precious power.

In the conventional constant-current driving method, the driving current through the LED is controllably constant. Although the LED driving current (and its associated illuminance) in the conventional constant-current method does not vary with respect to the fluctuating forward voltage VF, the LED, however, is connected in series with a current-sensing resistor, which disadvantageously consumes precious power.

For the foregoing reasons that either conventional constant-voltage or constant-current driving method wastefully consumes power, a need has arisen to propose a novel driving scheme with increased efficiency in power consumption, while maintaining constant driving current.

SUMMARY OF THE INVENTION

In view of the foregoing, it is an object of the present invention to provide system and method for driving the LED with constant current and illuminance, and with increased efficiency in power consumption.

According to the embodiment, the driving system includes a constant-current mode circuit for providing a constant current to the LED, and a constant-voltage mode circuit for providing a constant voltage to the LED. A switch is utilized to switch between the constant-current mode circuit and the constant-voltage mode circuit to assert constant-current mode and constant-voltage mode respectively. Accordingly, the forward voltage of the LED could be maintained constant, and the efficiency in power consumption could be substantially increased.

DETAILED DESCRIPTION OF THE INVENTION

Figure 1:
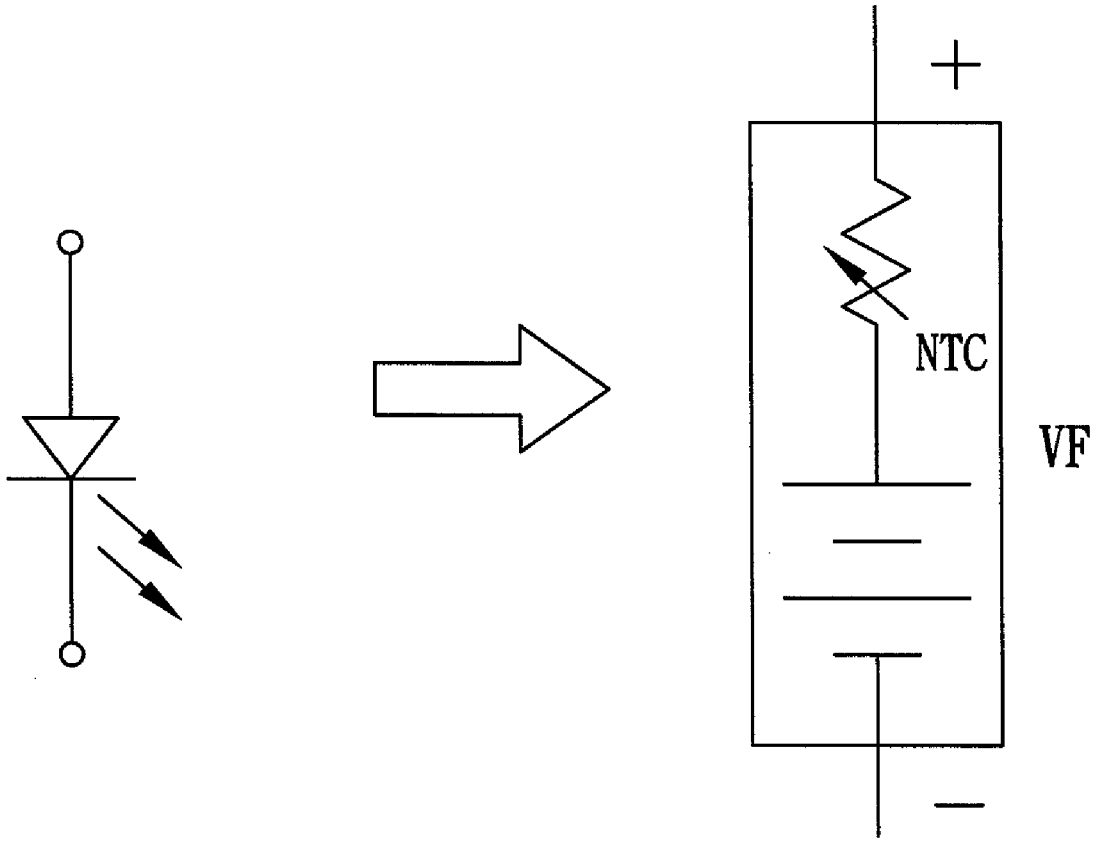
FIG. 1(Prior Art)
FIG. 1 shows an LED and its equivalent circuit.
Figure 2:
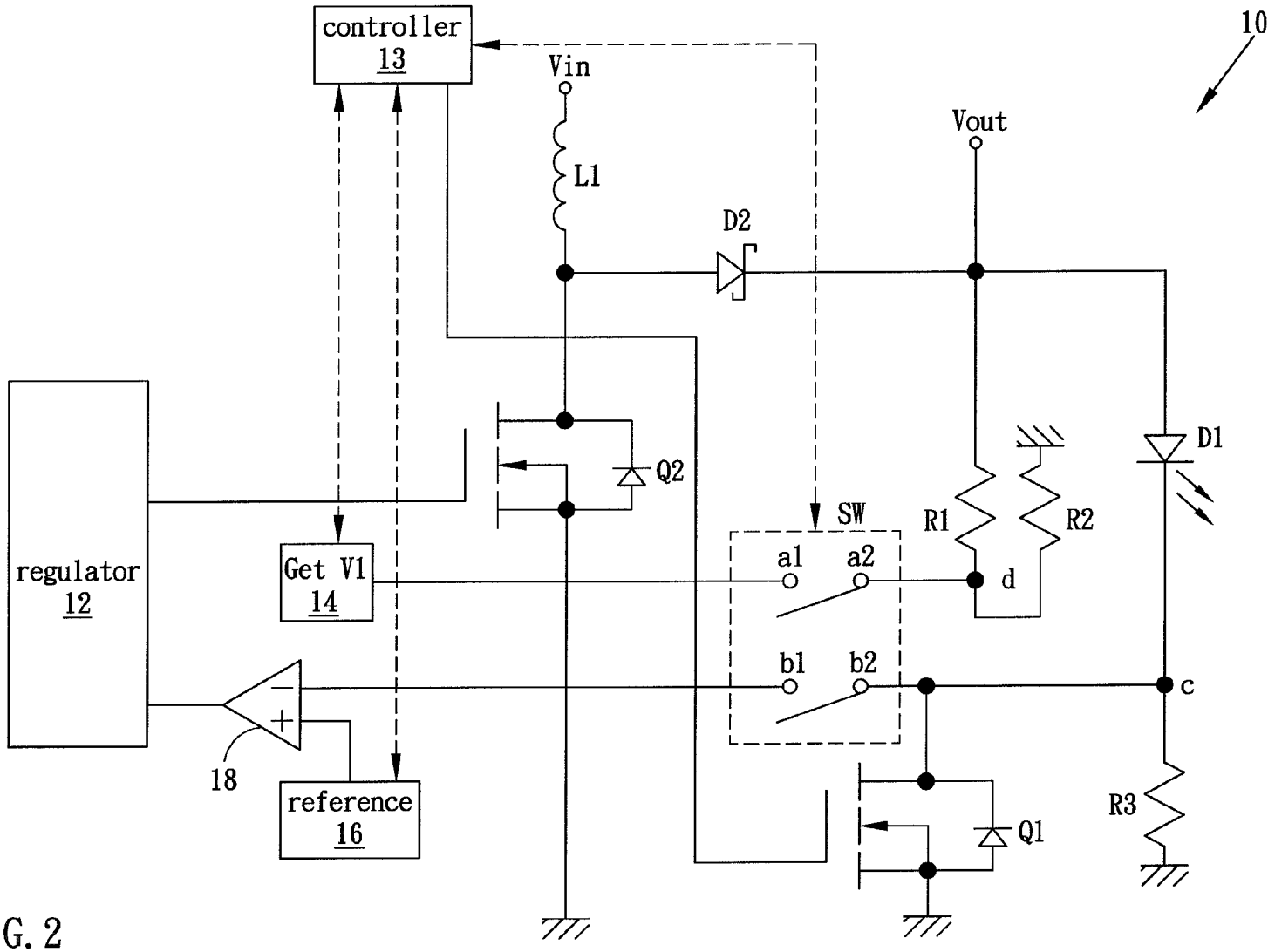
FIG. 2 illustrates a LED driving system according to one embodiment of the present invention.

FIG. 2 illustrates a LED driving system 10 according to one embodiment of the present invention. Although one LED is demonstrated in the embodiment, a person skilled in the pertinent art will appreciate that more than one LED may be adapted, and the LEDs may be connected in either series or parallel. In the embodiment, a regulator 12 continuously switches the transistor Q2 on and off in turn such that the supply voltage Vin stores energy in the inductor L1 when the transistor Q2 is turned on, and the stored energy is delivered to the LED D1 at the output node Vout when the transistor Q2 is turned off. The rectifying diode D2 is used to prevent the current from being returned from the output node Vout back to the supply voltage Vin. The switching duty cycle of the regulator 12 varies according to the output of an error comparator 18. For example, the switching duty cycle increases when the output of the error comparator 18 increases, indicating that the LED output voltage or current decreases; and vice versa.

According to the embodiment, the LED driving system 10 includes a current sensing resistor R3, which is connected, in series, between the cathode electrode of the LED D1 and the ground. The LED driving system 10 also includes a voltage divider R1-R2, which is connected between the anode electrode (or the output node) of the LED D1 and the ground. The error comparator 18 is coupled to compare a reference voltage (at the non-inverting end) and an input voltage (at the inverting end). The reference voltage and the input voltage are different in different modes, and will be described in details later. A controller 13, as will also be described later, is utilized to control and regulate the operation of the LED driving system 10. The controller 13 may be implemented by hardware circuitry, software program, or their combination. Further, the controller 13 may, in practice, be subdivided into connected or unconnected functional blocks.

Figure 3A:
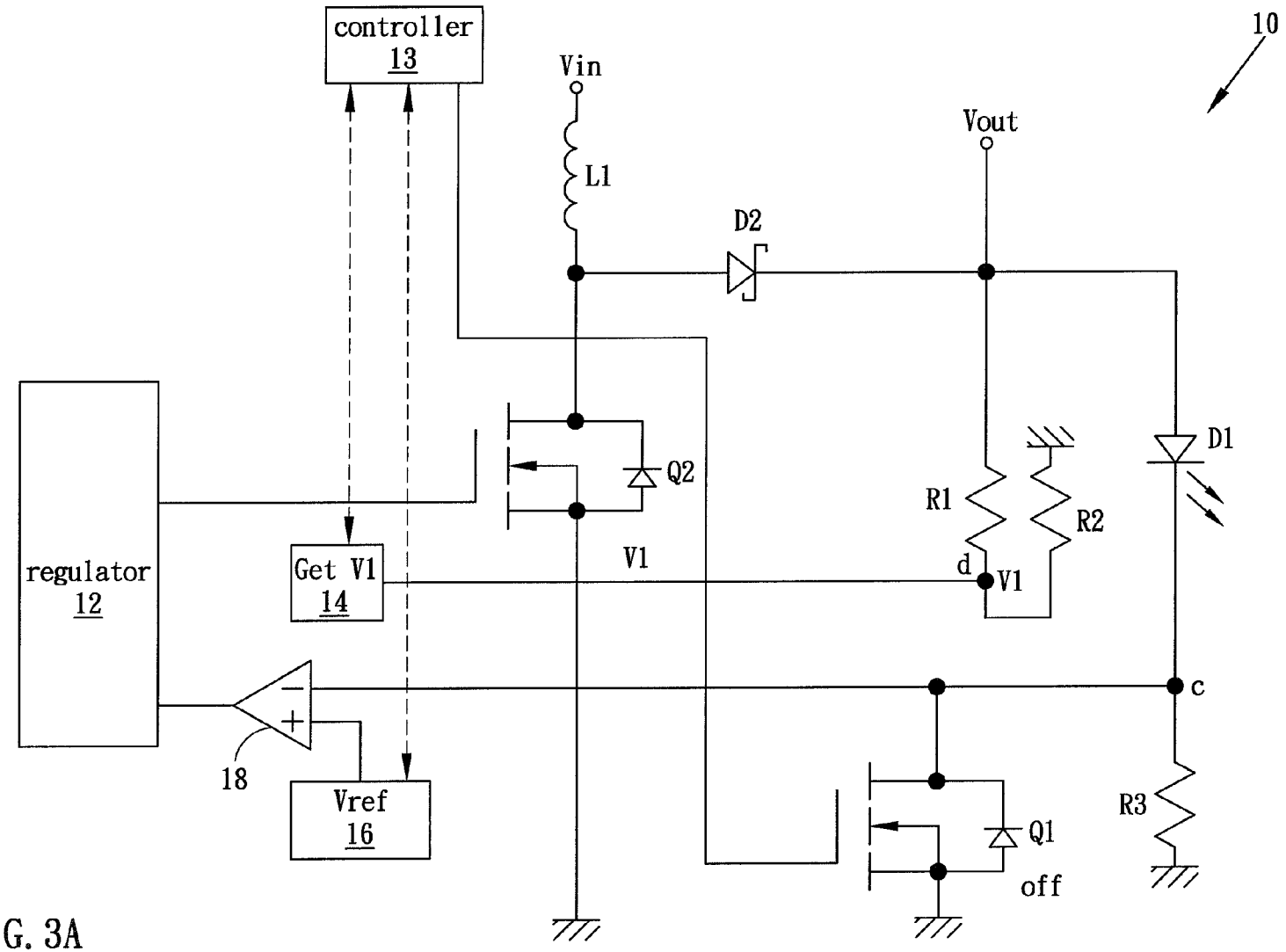
FIG. 3A illustrates the LED driving system of FIG. 2 in constant-current mode.
Figure 3B:
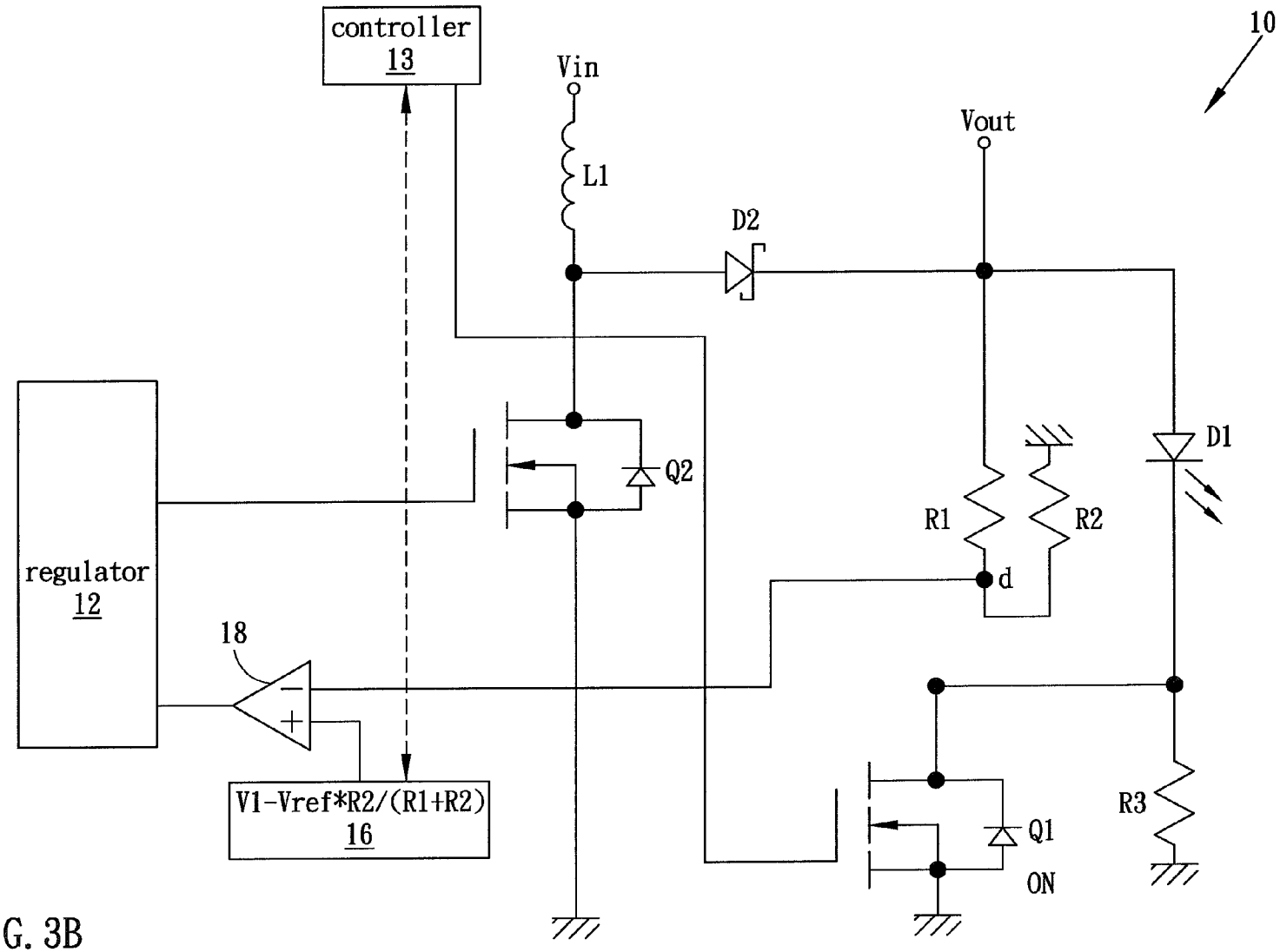
FIG. 3B illustrates the LED driving system of FIG. 2 in constant-voltage mode.
Figure 4:
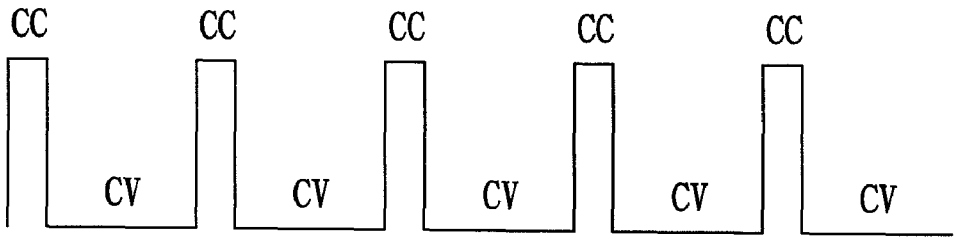
FIG. 4 shows the duty cycles between the constant-current mode (FIG. 3A) and the constant-voltage mode (FIG. 3B)

In the operation, the LED driving system 10 is operated in two modes in turn, that is, the constant-current (CC) mode and the constant-voltage (CV) mode. The switching between these two modes is schematically implemented by a switch SW, which is controlled by the controller 13. The constant-current mode is asserted when the connections a1-a2 and b1-b2 are made, as shown in FIG. 3A. Otherwise, the constant-voltage is asserted when the connection a2-b1 and floating b2 are made, as shown in FIG. 3B. The duty cycles of the constant-current (CC) mode and the constant-voltage (CV) mode are schematically exemplified in FIG. 4, in which the CC period is substantially shorter than the CV period. For example, the CC period may be a few mini second (ms) while the CV period may last a couple of minutes or longer.

Figure 5:
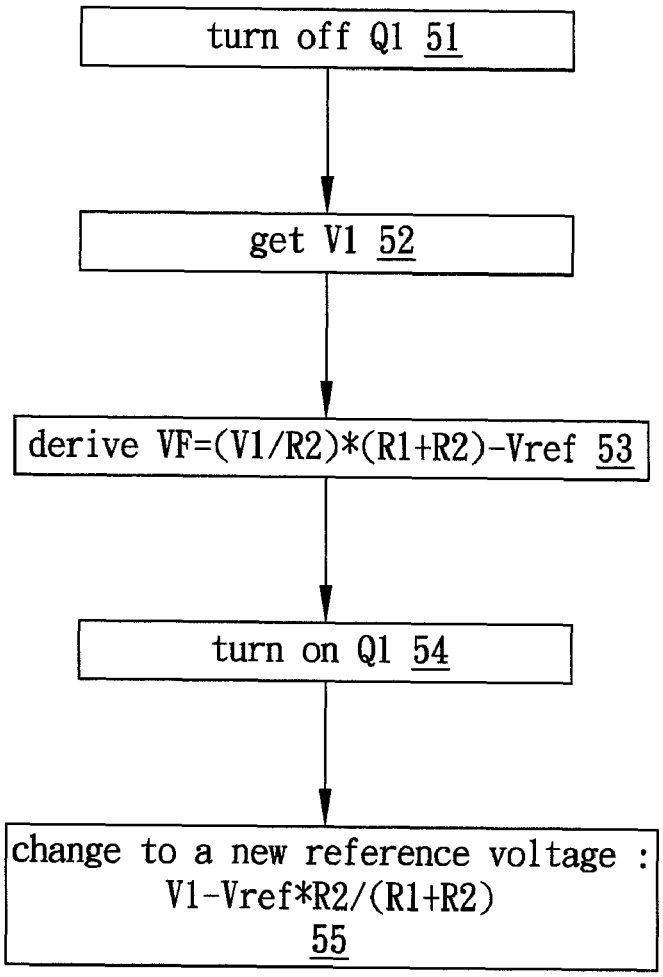
FIG. 5 shows the flow diagram of the LED driving system of FIGS. 2-3B.

Specifically speaking, in the constant-current mode as illustrated in the system diagram FIG. 3A and flow diagram FIG. 5, the controller 13 turns off the transistor Q1 (step 51), followed by acquiring the dividing voltage V1 at node d (block 14 and step 52) that is derived by the voltage divider R1-R2 across between the output node Vout and the ground. The acquired voltage V1 may, in the embodiment, be converted into the digital form by an analog-to-digital converter (ADC) and then temporarily stored in the controller 13 for the following operations. The voltage at node c (or the voltage potential across the current sensing resistor R3) is controllably maintained at a predetermined reference voltage Vref (block 16) by way of the error comparator 18. According to basic circuit law, $$V1=(R2/(R1+R2))*V\text{out}$$

or $$V\text{out}=(V1/R2)*(R1+R2)$$

Therefore, the forward voltage VF across the LED D1 could be derived, by the controller 13, as follows (step 53):

$$VF=V\text{out}-V\text{ref}=(V1/R2)*(R1+R2)-V\text{ref}$$

Subsequently, the LED driving system 10 enters into the constant-voltage (CV) mode (commanded, for example, by the controller 13) as illustrated in the system diagram FIG. 3B and flow diagram FIG. 5. The controller 13 turns on the transistor Q1 (step 54), therefore connecting the cathode electrode of the LED D1 to the ground and thus bypassing the resistor R3. In other words, no current now flows through the resistor R3, and thus no power is consumed in the resistor R3 in the CV mode. Subsequently, in step 55, the reference voltage 16 to the error comparator 18 is changed, by the controller 13, to a new reference voltage V1−Vref*R2/(R1+R2). In the embodiment, the controller 13 provides the new reference voltage in analog form by a digital-to-analog converter (DAC). Consequently, the voltage at the node d thus approaches towards the new reference voltage V1−Vref*R2/(R1+R2). According to basic circuit law, $$V1-V\text{ref}*R2/(R1+R2)=(R2/(R1+R2))*V\text{out}$$

or $$V\text{out}=(V1-V\text{ref}*R2/(R1+R2))*((R1+R2)/R2)=(V1/R2)*(R1+R2)-V\text{ref}=VF$$

Accordingly, the forward voltage VF of the LED D1 is maintained at the constant voltage VF. It is particularly noted that the resistor R3 no longer acts as a current-limiting resistor in the constant-voltage mode, and thus no power is consumed by the resistor R3 in this CV mode. By increasing the duty cycle of the CV mode (FIG. 4) as larger as possible, the efficiency in power consumption could be substantially increased compared to either the conventional constant-current driving method or the constant-voltage driving method.

Although specific embodiments have been illustrated and described, it will be appreciated by those skilled in the art that various modifications may be made without departing from the scope of the present invention, which is intended to be limited solely by the appended claims.

What is claimed is:

1. A system for driving a light-emitting diode (LED), comprising:

a constant-current mode circuit for providing a constant current to the LED;

a constant-voltage mode circuit for providing a constant voltage to the LED; and a switch for switching between the constant-current mode circuit and the constant-voltage mode circuit to assert constant-current mode and constant-voltage mode respectively;

wherein the constant-current mode circuit comprises:

a current sensing resistor connected in series to a cathode electrode of the LED; and an error comparator coupled to receive a predetermined reference voltage and a voltage across the current sensing resistor;

wherein the constant-voltage mode circuit comprises:

a voltage divider connected between an anode electrode of the LED and ground;

means for acquiring dividing voltage of the voltage divider;

means for deriving forward voltage of the LED;

a bypassing transistor coupled between the cathode electrode of the LED and the ground; and means for changing the reference voltage of the error comparator to a new reference voltage according to the dividing voltage, such that forward voltage of the LED is maintained at the derived forward voltage.

2. The system of claim 1, wherein the constant-current mode circuit and the constant-voltage mode circuit are asserted in turn.

3. The system of claim 1, further comprising a power supply for providing power to the LED.

4. The system of claim 3, wherein the power supply comprises:

a supply voltage;

an inductor;

a switching transistor connected between the inductor and ground;

a node between the inductor and the switching transistor for electrically coupling to anode electrode of the LED;

wherein the switching transistor is switched on and off such that the supply voltage stores energy in the inductor when the switching transistor is turned on, and the stored energy is then delivered to the LED when the switching transistor is turned off.

5. The system of claim 4, further comprising a rectifying diode connected between the node and the anode electrode of the LED.

6. A method for driving a light-emitting diode (LED), comprising:

maintaining a constant current through the LED in a constant-current mode;

acquiring a dividing voltage of an output voltage of the LED;

deriving a forward voltage of the LED;

grounding a cathode electrode of the LED in a constant-voltage mode; and maintaining a forward voltage of the LED at the derived forward voltage;

wherein the cathode electrode of the LED in the constant-voltage mode is grounded by a bypass transistor.

7. The method of claim 6, wherein the constant current through the LED in the constant-current mode is maintained by comparing a voltage across a current sensing resistor with a predetermined reference voltage.

8. The method of claim 6, wherein the dividing voltage of the output voltage of the LED is acquired by a voltage divider connected between anode electrode of the LED and ground.

9. The method of claim 6, wherein the forward voltage of the LED is derived according to the output voltage of the LED and the predetermined reference voltage.

10. The method of claim 6, wherein the forward voltage of the LED is maintained at the derived forward voltage by comparing the dividing voltage with a new reference voltage.

11. The method of claim 6, further comprising supplying power to the LED by intermittently storing energy from a supply voltage and then delivering the stored energy to the LED.

* * * * *